United States Patent [19]

Nomura

[11] Patent Number: 4,982,589

[45] Date of Patent: Jan. 8, 1991

[54] SWIVELING TYPE PLASTIC WORKING MACHINE

[75] Inventor: Hiroaki Nomura, Ichinomiya, Japan

[73] Assignee: Brother Kogyo Kabushiki Kaisha, Aichi, Japan

[21] Appl. No.: 476,568

[22] Filed: Feb. 7, 1990

[30] Foreign Application Priority Data

Feb. 14, 1989 [JP] Japan ..... 1-34558
Jul. 5, 1989 [JP] Japan ..... 1-173606

[51] Int. Cl.[5] ..... B21J 13/02
[52] U.S. Cl. ..... 72/67; 72/406
[58] Field of Search ..... 72/67, 406

[56] References Cited

U.S. PATENT DOCUMENTS 3,583,192 6/1971 Kocks .
3,768,289 10/1973 Mink ..... 72/76
3,990,285 11/1976 Dragoun .
3,990,286 11/1976 Cremonesi .
4,069,698 1/1978 Dragoun .
4,391,121 7/1983 Taruntaev .
4,698,992 10/1987 Bernet .

FOREIGN PATENT DOCUMENTS 238186 9/1987 European Pat. Off. .
3510250 10/1985 Fed. Rep. of Germany .
3539924 5/1987 Fed. Rep. of Germany .
60-227939 11/1985 Japan .
517514 6/1976 U.S.S.R. .
608590 5/1978 U.S.S.R. .
941003 7/1982 U.S.S.R. .
1061905 12/1983 U.S.S.R. .
319065 3/1929 United Kingdom .
1205171 9/1970 United Kingdom .
1224259 3/1971 United Kingdom .
1224260 3/1971 United Kingdom .

*Primary Examiner*—Lowell A. Larson
*Attorney, Agent, or Firm*—Oliff & Berridge

[57] ABSTRACT

A swiveling type plastic working machine such as a forging machine having a slanted molding die holder which is swivelled about a vertical axis. The molding die holder is fixed with a first molding die confronting a second molding die on which a workpiece is mounted. Rotation of the molding die holder about its axis is also controlled in connection with a slanting angle thereof relative to the vertical axis so as to provide no slippage between the first die and the workpiece, or so as to provide a controlled slippage therebetween.

12 Claims, 7 Drawing Sheets

$OP_0 = OP_0' = r$
$OP_0' = r\cos\theta$

SWIVELING TYPE PLASTIC WORKING MACHINE

BACKGROUND OF THE INVENTION

The present invention relates to a swiveling type plastic working machine such as a press-fitting or caulking machine and a rotary forging machine. More particularly, the invention relates to a swiveling type plastic working machine for pressing against a workpiece a molding die mounted on a molding die holder having a slanted axis intersecting with a vertical axis in the vicinity of a working portion, while swiveling the molding die holder about the vertical axis, thereby performing a plastic working to the workpiece. The term "swiveling" used herein means a circular rocking motion of a die with respect to the workpiece.

A conventional swiveling type plastic working machine of this type has been generally used as a "forging" machine for performing a "forging" work with plastically deforming a head of a rivet. The "forging" work is performed for the purpose of forming the head of the rivet into a simple flat shape or a simple curved shape and has hardly been used for forming a complicated shape. Also, in a rotary forging machine, it is common that a stationary lower molding die serves to form a complicated shape and a swiveling upper molding die is used for filling a workpiece into the lower molding die. Therefore, the surface worked by the upper molding die is of a simple flat configuration.

Accordingly, no particular attention has been drawn to a slippage between the dies and the workpiece, and the slippage is simply and incompletely avoided only by the frictional force naturally provided between the dies and the workpiece. For example, Japanese Utility Model Publication No. 55-38601 shows an arrangement in which a die is mounted on a shaft to be rotatable about its own axis so that the die may be rotated in accordance with the contact friction between the die and the workpiece.

Further, in the case where the head having a complicated shape is plastically machined by the machine of this type, an attempt has been made in which a pin is implanted in the molding die or the molding die holder so that the pin is brought into contact with a frame of the machine, or otherwise the pin is engaged with a vertical groove formed in the frame so that the complicated shape formed in the molding die surface is exactly translated to a surface of the workpiece.

Also, there has been proposed an arrangement in which two keys are used for the purpose of preventing a main shaft from being rotated during the swiveling operation.

However, it is impossible to control the revolving position of the die about its own axis with the former free revolving system which uses the frictional force. Therefore, in the case where a mold pattern is formed in a molding die (upper molding die), it is impossible to keep constant a rotational positional relation with the other molding die (lower molding die). It is thus impossible to use the free revolving system.

Also, the latter system in which the revolving operation is restricted by a pin or key suffers from a problem such that it is impossible to change a swinging or swiveling center of the upper molding die.

Further, in such a working operation, there is not only a case where any slippage between the dies and the workpiece is absolutely eliminated for forming a complicated molded surface but also another case where a controlled slippage therebetween is intentionally provided for additionally enhancing a surface roughness of the workpiece greater than that of the dies in, for example, spinning works. Accordingly, there has been a demand to realize the machine that is usable for both purposes. Related U.S. Pat. applications have been filed bearing Ser. No. 227,301 filed on Aug. 2, 1988, and Ser. No. 436,032 filed on Nov. 14, 1989.

SUMMARY OF THE INVENTION

In order to overcome the above-noted difficulties, an object of the present invention is to provide a swiveling type plastic working machine in which the revolution motion of the upper molding die is restricted relative to any swiveling swing motion of the upper molding die, to thereby prevent any slippage between the workpiece and the molding die and to keep constant the rotational positional relation between the confronted molding dies.

Also, another object of the invention is to provide a swiveling type plastic working machine in which, in contrast to the above-noted object, a plastic working is performed with generating a positively controlled slippage between the molding die and the workpiece.

Still another object of the present invention is to provide a swiveling type plastic working machine capable of selectively providing non-slippage of the die relative to the workpiece and selectively providing a controlled slippage therebetween.

In order to attain the above-noted objects, according to the invention, there is provided a swiveling type plastic working machine including a frame which provides a vertical axis, a first die, a die holder for mounting the first die, and a second die confronting the first die for mounting thereon a workpiece, the workpiece being depressed by co-operation of the first and second die, thereby applying a plastic working to the workpiece, the improvement comprising the die holder provided obliquely with respect to the vertical axis, the die holder having its slanted axis and having one end portion and another end portion to which the first die is fixed, the workpiece being positioned at a generally intersecting point between the vertical axis and the slanted axis, means for circularly moving the one end of the die holder to provide a swiveling motion thereof about the vertical axis, and means for controlling a self-rotation of the die holder about its slanted axis during swiveling movement of the die holder.

In another aspect of the invention, there is provided a swiveling type plastic working machine for performing a plastic working to a workpiece by depressing against the workpiece a molding die mounted on a molding die holder while swiveling the molding die holder about a vertical axis, the molding die holder having a slanted axis intersecting with the vertical axis in the vicinity of a working portion, the plastic working machine comprising a first servo motor for drivingly swiveling the molding die holder about the vertical axis, a second servo motor for rotating the molding die holder about the slanted axis, and a numerical control means for controlling the first and second servo motors.

In the thus constructed swiveling type plastic working machine, the revolution or self-rotation of the molding die holder about its axis is directly controlled by the second servo motor. In an embodiment in which the first and second servo motors are synchronously controlled to meet the predetermined relationship, the rotary velocity of the slanted contact line of the molding die with the workpiece on the working surface is equal to the revolution velocity of the molding die about its axis.

In still another aspect of the invention, there is provided a swiveling type plastic working machine for performing a plastic working to a workpiece by depressing against the workpiece a molding die mounted on a molding die holder while swiveling the molding die holder about a vertical axis, the molding die holder having a slanted axis intersecting with the vertical axis in the vicinity of a working portion, the plastic working machine comprising a frame, a first servo motor for drivingly swiveling the molding die holder about the vertical axis, a first annular member rotatably supported about the vertical axis by the frame, a second servo motor for drivingly rotating the first annular member, a first shaft extending in a direction substantially perpendicular to the vertical axis, a second annular member positioned within the first annular member and supported by the first shafts to the first annular member, the second annular member being movable in an axial direction of the first shaft and swingable about an axis of the first shaft relative to the first annular member, a second shaft extending in a direction substantially perpendicular to the first shaft, a third annular member positioned within the second annular member and supported by the second shaft to the second annular member, the third annular member being movable in an axial direction of the second shaft and swingable about an axis of the second shaft relative to the second annular member, connecting means for connecting the third annular member to the molding die holder, the connecting means permitting the molding die holder to be movable in an axial direction thereof relative to the third annular member but preventing the molding die holder from being rotated about its slanted axis relative to the third annular member, and a numerical control means for controlling rotations of the first and second servo motors, whereby a slippage between the molding die and the workpiece is controlled from a zero to a predetermined level during the working operation.

Since the molding die holder is engaged with the three annular members and the first annular member is driven by the second servo motor, the revolution position of the molding die holder is directly controlled by the second servo motor. The operation of the molding die holder other than the revolution thereof is not restricted.

In still another aspect of the invention, there is provided a swiveling type plastic working machine for performing a plastic work to a workpiece by depressing against the workpiece a molding die mounted on a molding die holder while swiveling the molding die holder about a vertical axis, the molding die holder having a slanted axis intersecting with the vertical axis in the vicinity of a working portion, said plastic working machine comprising a first shaft extending in a direction perpendicular to the vertical axis, a first annular member supported by the first shaft to the frame, the first annular member being movable in an axial direction of the first shaft and swingable about an axis of the first shaft relative to the frame, a second shaft extending in a direction perpendicular to the first shaft, a second annular member positioned in the first annular member and supported by the second shaft to the first annular member and means for connecting the molding die holder to the second annular member, the connecting means allowing the molding die holder to be movable in an axial direction thereof relative to the second annular member and preventing the molding die holder from being rotated relative to the second annular member, whereby rotation of the die holder about its slanted axis is prevented during swiveling motion thereof.

Since the first annular member is supported to the frame and no drive means if connected to the first annular member, the first annular member cannot be rotated about its axis. Therefore, the molding die holder also cannot be rotated about its axis.

BRIEF DESCRIPTION OF THE DRAWINGS

In the drawings;

FIG. 2(*b*) is a view showing the molding die and moving locus of the generatrix given on the conical surface;

DETAILED DESCRIPTION OF THE PREFERRED EMBODIMENTS

Figure 1:
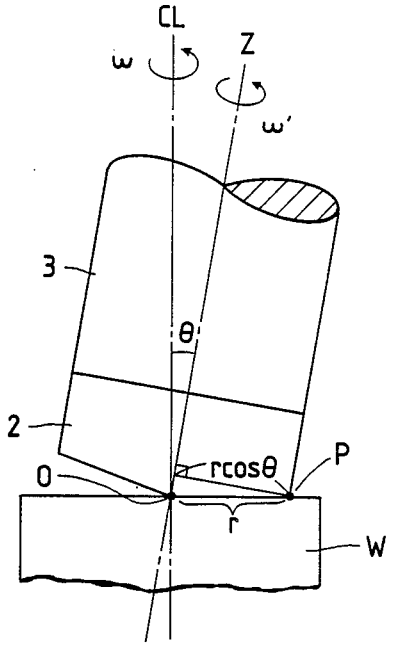
FIG. 1 is a view showing a molding die and a workpiece for description of slippage therebetween.

A slippage between a molding die and a workpiece in such a forging machine will first be explained with reference to FIGS. 1 thru 2(*b*) prior to the description of the preferred embodiments according to this invention.

A molding die holder 3 is supported by a holder supporting body (not shown) so as to allow the holder 3 to be swiveled about a vertical axis CL—CL, and the molding die holder 3 itself may be freely revolved about its slanting axis Z—Z that intersects with the vertical axis CL—CL at an angle $\theta$ in the vicinity of the working portion. A die 2 is mounted at the working portion of the distal end of the molding die holder 3.

Now, assuming that the vertical axis CL—CL and the slanted axis Z—Z are intersected with each other at a point 0; the point 0 being located on a contact line between the die 2 and the workpiece W; an upper surface of the workpiece W being a flat surface extending perpendicular to the vertical axis CL—CL; and the molding die 2 having a conical shape provided with an apex at the point 0 with an apex angle of $2\times(\pi/2-\theta)$. At this time, the molding die 2 and the workpiece W are in contact with each other on a line 0-P extending radially from the point 0. When the molding die 2 and the workpiece W are rotatingly moved relative to each other in accordance with the swiveling motion of the molding die holder 3 without any slippage therebetween, the contact line 0-P is moved to form a sector shape about the point 0 on the above-described surface. The contact line is moved on the conical surface having the apex at the point 0 in terms of the molding die 2. If the contact line is located at the initial position O-Po and assuming that a length of the line 0-Po is r, the point P is moved along an arcuate line of the radius r "on the workpiece W", but is moved along the conical surface of the radius of rcos $\theta$ "on the molding die 2". Accordingly, upon the contact point returning the initial point Po on the molding die, the point P is moved through a distance of $2\pi r\cos\theta$ along the conical surface of the molding die 2. If this movement is projected onto an upper surface of the workpiece, the path is obtained as shown in FIG. 2(*a*). Namely, although the contact point is returned back to the initial point Po on the molding die, there is the rest of the distance of $2\pi r-(2\pi r)(\cos\Theta)$ on the workpiece as shown in FIG. 2(*a*).

Figure 2A:
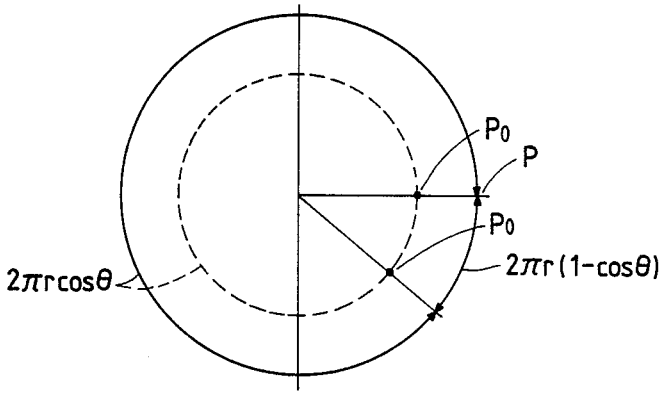
FIG. 2(*a*) is a projected view showing moving locus of a generatrix given on a conical surface of the molding die.
Figure 2B:
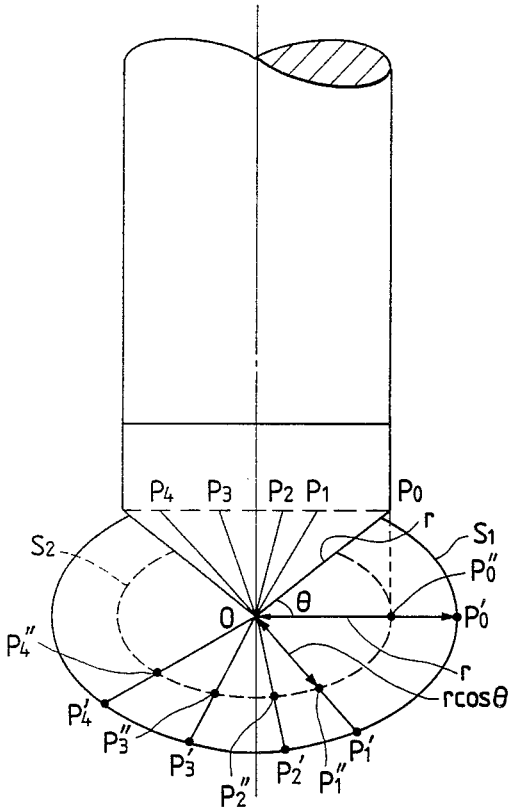

In other words, FIG. 2(*b*) shows a vertically extending die holder 3. In reality, the die holder 3 is slanted by an angle $\theta$ with respect to the vertical line CL. Here, assuming that a generatrix line OP1 given on the conical surface of the molding die 2 is in contact with a flat surface of the workpiece at a line OP1', and if the die holder 3 cannot be revolved about its axis Z, the specific generatrix line OP1 is always in sliding contact with the surface of the workpiece to provide an arcuate locus Po'P1' at an imaginary circle S1 in accordance with a swiveling motion of the die holder 3. This state means complete slippage of the die 2 relative to the workpiece, as if a wiper blade of an automobile scrapes a front window (here, only the specific line OP1 always in contact with the workpiece and moves thereover.)

If such movement of the line OP1 is projected, the projected moving locus of the line OP1 is delineated as an arcuate curve OPo"OPl" at an imaginary circle S2. Therefore, there is a difference in moving locuses between Po'P1' and Po"P1". This difference can be considered to be the slippage. If the line OP on the die 2 is circularly moved at the angular velocity of $\omega$, the arcuate length of the Po'Pl' is given by r $\omega$ T, the arcuate length of the Po"Pl" is given by rcos $\theta$ $\omega$ T. Therefore, in order to make the arcuate length on the circle S2 equal to the arcuate length OPo'OP1', the line OP1 must be further moved at an imaginary angular velocity $\omega'$faster than $\omega$. This imaginary angular velocity is provided by revolving the die holder 3 about its axis Z in addition to the moving velocity of the line OP1. Further, for providing non-slippage, a rolling contact is required (not the line scraping contact). Therefore, during swiveling motion of the die 2, generatrix lines are successively changed in the order of OP1, OP2, OP3, OP4, etc, so as to obtain the moving locus of at the circle S1 given by the line OP1', OP2', OP3', OP4', etc. Accordingly, the die holder 3 must be rotated at an angular velocity of $\Delta\omega$ which is a difference of $\omega$- $\omega'$. In other words, in order to increase moving velocity of the generatrix lines, the die holder 3 must be revolved in a direction opposite the swiveling direction of the die holder.

The following relationship is established in the movement of the point P in terms of an angular velocity $\omega$ about the vertical line CL—CL on the workpiece and an imaginary angular velocity $\omega'$ about the slanted axis on the molding die so as to provide no slippage between the die and the workpiece. That is, if there is no slippage therebetween, the moving locuses described above is equal to each other, so that the following relationship can be established.

$$r\omega = r\cos\theta\,\omega'$$

This equation reveals that;

$$107\,'107 = 1/\cos\theta \qquad (1)$$

Accordingly, the difference $\Delta\omega$ between both the angular velocities is expressed as follows.

$$\Delta\omega = \omega' - \omega(1/\cos\theta - 1)\omega \qquad (2)$$

The angular velocity is an angular velocity actually defined by the circular motion of the die holder supporting body. However, the angular velocity $\omega'$ is a nominal velocity of the contact line 0-P on the molding die 2, and is not an angular velocity actually defined by a structural part. However, if the difference between the two angular velocities is not imparted between the moving generatrix line on the molding die 2 and the die supporting body for drivingly swiveling the molding die holder 3, slippage is provided between the molding die 2 and the workpiece W. Therefore, in order to solve this inconsistency, it is necessary to circularly move the supporting body and the molding die 2 in the direction opposite to each other and to provide the positive revolution of the die holder at an angular velocity which meets the following equation:

$$\Delta x = (1/\cos\theta - 1)\omega \qquad (3)$$

If this is met, the die supporting body actually rotates at the angular velocity $\omega$ and the molding die 2 rotates at the angular velocity in the opposite direction. The nominal angular velocity $\omega'$ of the contact line O-P between the molding die 2 and the workpiece W on the molding die is represented as follows.

$$\omega' = \Delta\omega + \omega = (1/\cos\theta)\omega \qquad (4)$$

Accordingly, by controlling the revolving motion of the molding die holder 3 about the slanted axis Z—Z in synchronism with the swiveling motion of the molding die holder 3 about the vertical axis CL—CL, it is possible to control the slippage between the molding die 2 and the workpiece W.

Figure 3:
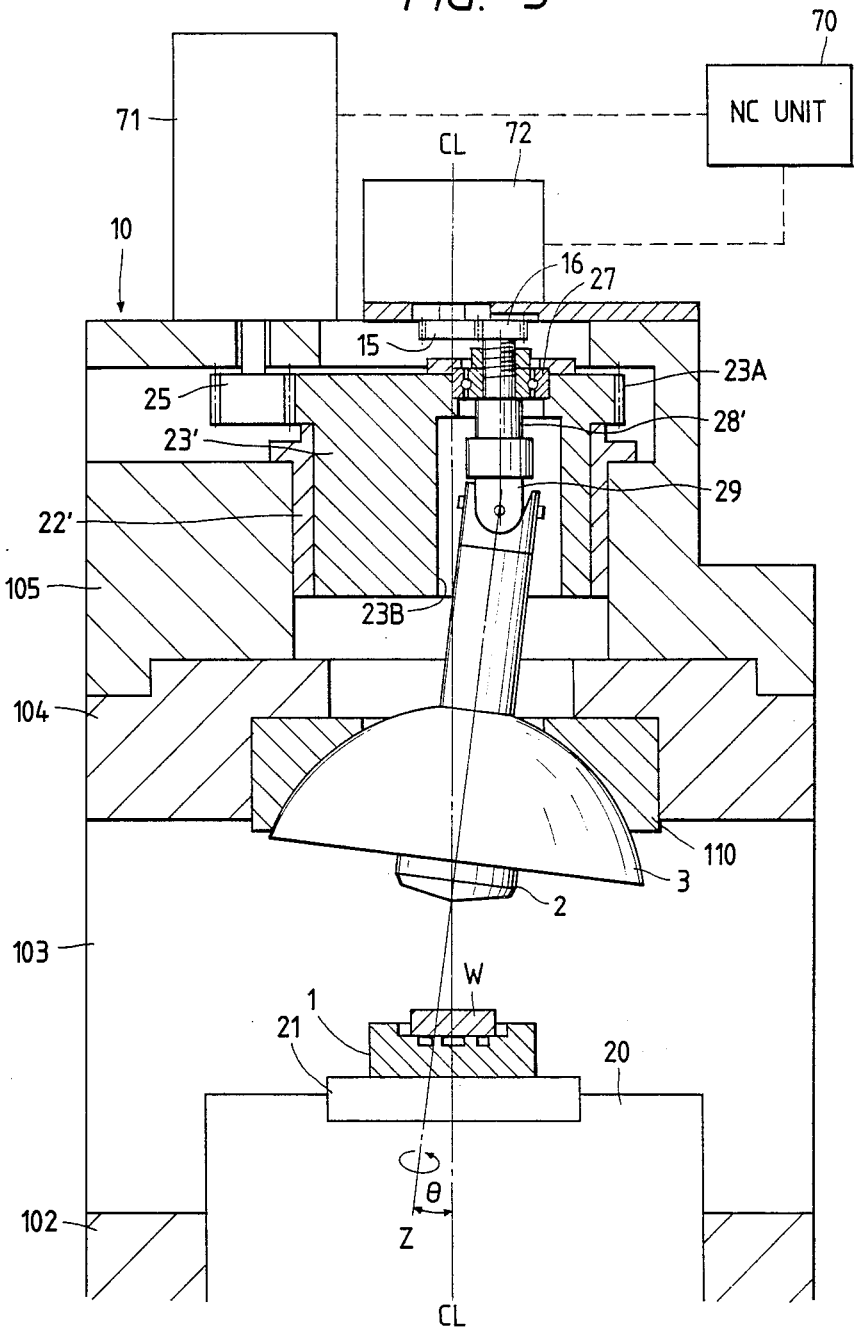
FIG. 3 is a cross-sectional view showing a swiveling type forging machine according to a first embodiment of the present invention.

A swiveling type plastic working machines will be described by way of various embodiments. FIG. 3 is a cross-sectional view showing a swiveling type rotary forging machine according to a first embodiment of the present invention.

A body frame 10 is integrally formed of a bed portion 102, a side plate 103, an upper plate 104, and an upper block portion 105. A ram 20 is slidingly guided in the vertical direction in the bed portion 102 and is movable up and down by a drive means (not shown). A lower die base 21 is provided on a top surface of the ram 20, and a lower molding die 1 is fixed on the die base 21.

A rotary sleeve 23' is rotatably supported through a sliding sleeve 22' to the upper block portion 105. The rotary sleeve 23' has an eccentric inner hole portion 23B. The rotary sleeve 23' has a flanged portion whose outer peripheral surface is provided with a gear 23A. The gear 3A of the rotary sleeve 23' is in meshing engagement with a gear 25 of an output shaft of a rotational drive motor 71 mounted on a top surface of the upper block portion 105 of the body frame 10.

A rotary drive shaft 28' is vertically supported through a bearing 27 to the rotary sleeve 23' at an eccentric position thereof. The drive shaft 28' extends into the inner hole portion 23B in which a shaft portion of a die holder 3 is positioned. An upper end of the molding die holder 3 is connected to the rotary drive shaft 28' through a universal joint 29.

On the other hand, an upper axial end of the rotary drive shaft 28' is projected above the rotary sleeve 23' with a gear 16 being fixed to the axial end. The gear 16 of the rotary drive shaft 23' is meshed with a gear 15 of an output shaft of a revolution drive motor 72 mounted on the body frame 10. The revolution drive motor 72 is mounted on the frame 10 in such a manner that a center axis of the output shaft of the motor 72 is coincident with a center axis CL of the machine.

The molding holder 3 integrally has a parasol-like member at a lower portion of the shaft portion. The upper molding die 2 is held at a bottom surface of the parasol-like member. The upper surface of the parasol-like member is of hemispherical shape and is in sliding contact with an annular spherical seat 110 fixed to the upper plate portion 104 of the body frame 10. The pressure for pressing the workpiece W laid on the lower molding die 1 is supported by the upper plate portion 104 of the body frame 10 through the spherical seat 110.

The rotary drive motor 71 and the revolution drive motor 72 are connected to an NC unit 70 for being controlled thereby. The rotary drive motor 71 and the revolution drive motor 72 constitute first and second servo motors, respectively. The rotary drive motor 71 functions as means for circularly moving one end of the die holder 3 to provide a swivelling motion thereof about the vertical axis CL. Further, the rotary drive motor 72 and the NC unit 70 function as means for controlling the self-rotation of the die holder about its axis during swiveling movement of the die holder 3.

The operation will be explained. When the rotary drive motor 71 is rotated, the rotary sleeve 23' is rotated about the axis CL because of the meshing engagement of the gears 25 and 23A. In the rotation of the rotary sleeve 23', the eccentrically positioned bearing 27 is circularly moved about the axis CL, so that the molding die holder 3 is swivelingly driven under a slanted condition. At this time, the revolution of the rotary drive shaft 28' about its own axis is controlled by the revolution drive motor 72 through the gear 16. Accordingly, the revolution of the molding die holder 3 connected through the universal joint 29 is also controlled in the same manner.

Accordingly, it is possible to control the revolution of the molding die holder 3 so that there is no slippage between the workpiece W and the upper molding die 2 by the suitable synchronous control of the rotations of the rotary drive motor 71 and the revolution drive motor 72 in response to the slanted angle $\theta$ of the molding die holder 3 by means of the NC unit 70. Also, it is possible to control the revolution so that the rotational positional relation with the lower molding die 1 is kept constant.

For instance, if the angular velocity $\omega 2$ of the molding die holder 3 driven by the revolution drive motor 72 is controlled relative to the angular velocity $\omega$ of the rotary sleeve 23' driven by the rotary drive motor 71 so as to meet the following relationship, there is no slippage between the workpiece W and the upper molding die 2.

$$\omega 2 = \omega + \Delta\omega \tag{5}$$

where $\Delta\omega$ is the angular velocity given by the aforesaid equation (3).

Namely, the numerical control unit 70 may control the two servo motors 71 and 72 so that the swiveling direction of the molding die holder 3 about the vertical axis CL and the revoluting direction thereof about the slanted axis Z are opposite to each other; and the swiveling angular velocity $\omega$ and the revolution angular velocity $\Delta\omega$ meet the following relationship.

$$\Delta\omega = (1/\cos\theta - 1)\omega$$

where $\theta$ is the angle defined between the slanted axis Z and the vertical axis CL.

Also, inversely, the revolution drive motor 72 may be rotated at a high speed to thereby positively generate the controlled slippage between the upper molding die 2 and the workpiece W, resulting in an enhancement of the surface roughness of the workpiece which is much smoother than that of the upper molding die 2 as in the spinning machining.

Next, a swiveling type rotary forging machine according to a second embodiment will be described with reference to FIGS. 4 and 5. In the foregoing embodiment, the revolution position of the molding die holder 3 about the axis Z is controlled by directly coupling the rotary drive shaft 28' to the shaft portion of the die holder 3. However, it is also possible to effect restriction to the revolution position of the molding die 2 by using a mechanism for restricting a revolutional position of the molding die holder 3, yet allowing the die holder to be swiveled about the center line CL.

Figure 4:
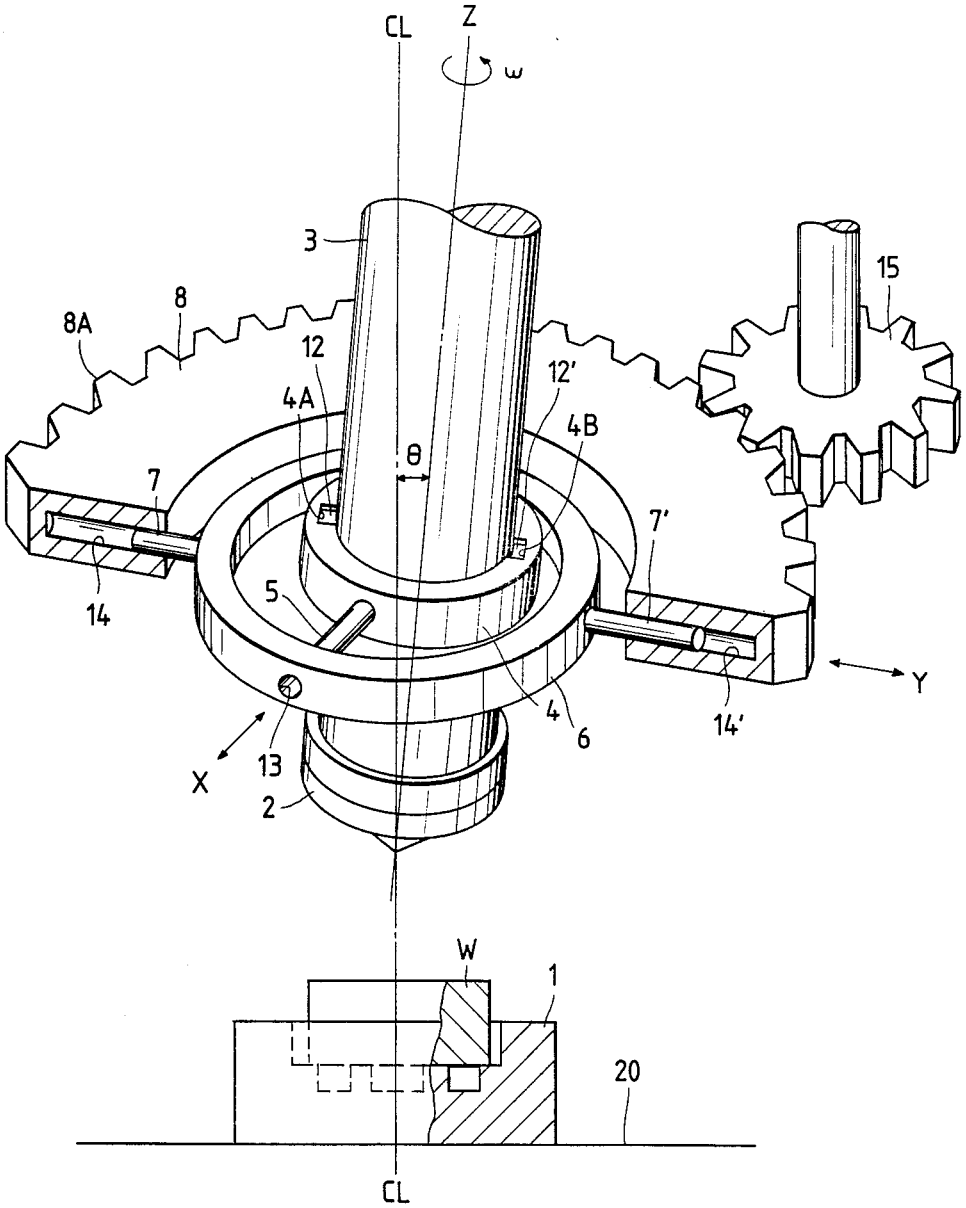
FIG. 4 is a perspective view showing a primary part of a molding die revolution control mechanism used in a swiveling type forging machine according to a second embodiment of the present invention.

FIG. 4 is a perspective view schematically showing a molding die revolution controlling mechanism. In the mechanism, used are first thru third annular members 8, 6 and 4. The second annular member 6 is positioned within a space of the first annular member 8 and is supported thereby, and the third annular member 4 is positioned within a space of the second annular member 6 and is supported thereby. These annular members 8, 6 and 4 are disposed generally concentrically, but are relatively movable to one another.

To be more specific, a lower molding die 1 is fixed to a ram 20 and a workpiece W is mounted on the lower molding die 1. An upper molding die 2 is mounted on a molding die holder 3 in confronted relation with the lower molding die 1. The upper molding die 2 is drivingly rotated is obliquely oriented relative to the vertical center axis CL of the machine. The revolution of the upper molding die is controlled or restricted by the molding die revolution controlling mechanism.

The third annular member 4 is disposed over an outer peripheral surface of a shaft portion of the molding die holder 3. The third annular member 4 has two grooves 4A and 4B in its inner side and at diametrically opposite sides. Two short pins 12 and 12' are implanted in and projected from the molding die holder 3, and are engaged with the grooves 4A and 4B. With this structure, the third annular member 4 is slidably moved in the axial direction Z of the molding die holder 3 but is rotated together with the molding die holder 3, i.e., the third annular member 4 is not rotatable relative to the shaft portion of the die holder 3.

Two swing shafts 5 and 5' extend radially outwardly from the third annular member 4 in the diametrically opposite directions (X direction in FIG. 4). The swing shafts 5 and 5' constitute "second shafts". The second annular member 6 is engaged with the two swing shafts 5 and 5'. Namely, radial through holes 13 and 13' are provided in the second annular member 6, and the swing shaft 5 and 5' are inserted into and supported by the holes 13 and 13'. With the structure, the third annular member 4 is swingable about an axis of the swing shafts 5 and 5', and the third annular member 6 is supported by the second annular member and is slidably movable in the axial direction (X direction) of the swing shafts 5 and 5'.

Drive shafts 7 and 7' extend radially outwardly from the second annular member 6 in the diametrically opposite direction (Y direction) perpendicular to the swing shafts 5, 5'. The drive shafts 7 and 7' form "first shafts". The first annular member 8 is engaged with the two drive shafts 7 and 7'. Namely, the first annular member 8 has radial holes 14 and 14' in its inner portion and in diametrical direction of the member 8. The drive shafts 7 and 7' are inserted into and supported by the holes 14 and 14'. With this structure, the second annular member 6 is supported by the first annular member 8 to be swingable about an axis of the drive shafts 7 and 7' and to be slidable in the axial direction of the swing shafts 7 and 7' (in the Y-direction).

The first annular member 8 is supported to the body frame 10 (not shown in FIG. 4 but shown in FIG. 5) to be rotatable about the center axis CL of the machine. Teeth 8A are formed around an outer periphery of the first annular member 8 to form a gear. The first annular member 8 forming the gear is in mesh with a drive gear 15 so that rotational position of the first annular member 8 is controlled thereby. The servo motor 71 functions as means for circularly moving the one end of the die holder 3, and the servo motor 72, the NC unit 70, the first thru third annular members 8,6,4 the first and second shafts 7,7',5,5', the drive gear 5 serve as means for controlling the self-rotation of the die holder 3 about its axis during swivelling movement of the die holder.

The operation will be explained. The third annular member 4 is movable in a horizontal plane (X-Y plane) because of the sliding movement in the axial direction (Y-direction) of the drive shafts 7 and 7' and the sliding movement in the axial direction (X-direction) of the swing shafts 5 and 5'. The third annular member 4 can be swiveled about any axis extending through the XY plane because of the swing movement of the second annular member 6 about the drive shafts 7 and 7' and the swing movement of the third annular member 4 about the swing shafts 5 and 5'. Further, the movement of the die holder 3 in the axial direction (Z-direction) is not restricted by the third annular member 4 because of the sliding engagement between the axially extending grooves 4A, 4B and pins 12, 12'. Accordingly, the molding die holder 3 may take any posture and the revolution position about the axis Z is only restricted through the engagement between the pins 12, 12' and the grooves 4A, 4B, i.e., by the rotational position of the first annular member 8 given by the engagement between the gear 8A and the drive gear 15.

Accordingly, it is possible to control the revolution of the molding die holder 3 about its axis by controlling the rotation of the drive gear 15. By controlling the drive shaft of the gear 15 in synchronism with the swiveling motion of the molding die holder 3, it is possible to rotate the upper molding die 2 without any slippage relative to the workpiece W.

Figure 5:
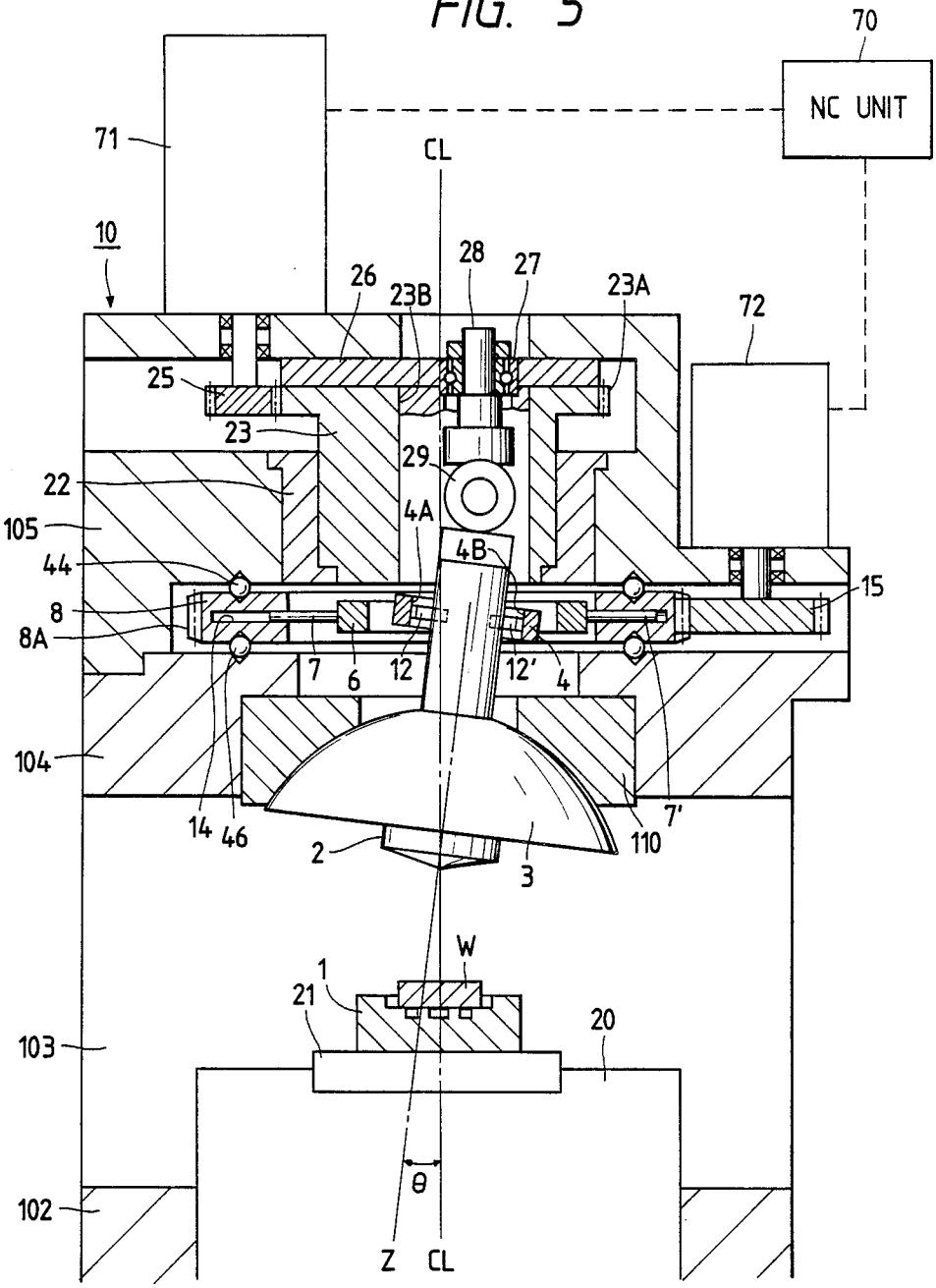
FIG. 5 is a cross-sectional view showing the swiveling type forging machine incorporating the molding die revolution control mechanism according to the second embodiment of this invention.

FIG. 5 is a cross-sectional view showing a rotary forging machine incorporating therein the molding die revolution controlling mechanism shown in FIG. 4.

The body frame 10 is integrally formed of a bed portion 102, a side plate portion 103, an upper plate portion 104, and an upper block portion 105. The ram 20 is slidably guided in the vertical direction and is raised or lowered by a drive means (not shown). An upper die base 21 and a lower molding die 1 are fixed to a top surface of the ram 20.

A rotary sleeve 23 is rotatably supported through a sliding sleeve 22 to the upper block portion 105 of the body frame 10. The rotary sleeve 23 has an eccentric inner hole portion 23B. A gear 23A is formed on a circumferential surface of a flanged portion of the rotary sleeve 23. The gear 23A of the rotary sleeve 23 is meshed with a gear 25 of an output shaft of a rotary drive motor 71 mounted on the body frame 10. A disc 26 is fastened to an upper end face of the rotary sleeve 23 by bolts not shown. A rotary support shaft 28' is vertically supported to the disc member 26 through a bearing 27 at an eccentric position of the disc 26. An upper end of the molding die holder 3 is connected to the rotary support shaft 28 by a universal joint 29.

The molding die holder 3 has an integral parasol-like member at a lower portion of the shaft portion thereof. The upper molding die 2 is held to a bottom surface of the parasol-like member. The upper surface of the parasol-like member is of hemispherical shape, and is in sliding contact with an annular spherical seat 110 fixed to the upper plate portion 104 of the body frame 10. The pressure for pressing the workpiece W laid on the lower molding die 1 is received by the upper plate portion 104 of the body frame 10 through the spherical seat 110. The above described components in the forging machine are similar to those used in the forging machine shown in FIG. 3, except the motor driven shaft 16 (first embodiment) and the rotation support shaft 28 (second embodiment).

The molding die revolution controlling mechanism explained in conjunction with FGI. 4 is engaged with the shaft portion of the molding die holder 3. Namely, the first annular member 8 is rotatably supported by two spherical connection chains 44 and 46 between the upper plate portion 104 and the upper block portion 105 of the body frame 10. The center line of rotation of the first annular member 8 is coincident with the center line CL of the machine vertical to the lower molding die 1. The first annular member 8 is meshedly engaged with the drive gear 15 mounted on the output shaft of a revolution drive motor 72. The revolution drive motor 72 is mounted on the body frame 10.

The second annular member 6 is supported through the drive shafts 7 and 7' to the circumferential portion of the first annular member 8. The third annular member 4 is supported through the drive shafts 5, 5' (not shown in FIG. 5) to the inner circumferential portion of the second annular member. The shaft portion of the molding die holder 3 is inserted into the third annular member 4 with the implanted pins 12, 12'being engaged with the grooves 4A, 4B formed in the third annular member 4.

The rotary drive motor 71 and the revolution drive motor 72 are connected to and controlled by the NC unit 70.

The operation will be explained. When the rotary drive motor 72 is rotated, the rotary sleeve 23 is rotated so that the bearing 27 located in the eccentric position of the disc member 26 is circularly moved about the machine center axis CL. Therefore, the molding die holder 3 performs swiveling motion with slanted condition. At this time, the revolution of the rotary support shaft 28 is freely performed, so that the revolution of the molding die holder 3 connected through the universal joint 29 thereto is also not restricted by the rotation of the rotary sleeve 23. Instead, the revolution position of the molding die holder 3 is restricted or limited by the rotational position of the first annular member 8.

Accordingly, it is possible to control the revolutional position of the molding die holder 3 so that there is no slippage between the workpiece W and the upper molding die 2 by the suitable synchronous control of the rotations of the rotary drive motor 72 and the revolution drive motor 72 in response to the slanted angle $\theta$ of the molding die holder 3 by means of the NC unit 70. It is also possible to control the revolution so that the rotational positional relation with the lower molding die 1 is kept constant.

In the second embodiment, the first annular member 8 is drivingly rotated in synchronism with the swivel rotation of the molding die holder 3 by the NC unit 70. However, in a rotary forging machine in which the slant angle $\theta$ of the molding die holder 3 is kept constant, the drive gear 15 and the rotary drive motor 72 may be connected to each other through a gear mechanism for synchronous rotation.

Further, in the second embodiment, since the mechanism for restricting or controlling the revolution of the die holder 3 uses the simple three annular members 4, 5 and 8, the revolution position of the molding die 2 can be controlled independently of the swivel rotational position of the molding die 2. Accordingly, it is possible to perform a rotational forging by a perfect rolling contact without any slippage between the molding die 2 and the workpiece W, to thereby enhance the working efficiency. Also, since the rotational positional relation between the confronted molding dies 1 and 2 may be controlled, it is possible to perform the rolling forging while providing a mold pattern also to the upper molding die 2.

A swiveling type rotary forging machine according to a third embodiment of this invention will next be described with reference to FIGS. 6 and 7. In the foregoing two embodiments, the revolution position of the molding die holder 3 is controlled by the revolution drive motor 72. However, it is also possible to control the revolution position of the molding die by using a molding die revolution preventing mechanism for completely preventing the revolution of the molding die holder 3 and fixing the holder at a position. In other words, the concept for controlling the self-rotation of the die holder is applied to the prevention of the die holder from its self-rotation.

In the following third embodiment, there is provided a molding die revolution preventing mechanism for restricting the revolution position of the molding die holder 50 to a constant position even if the swivel center of the molding die holder 50 is shifted in a direction parallel with the center axis CL or even if swinging center line is moved.

Figure 6:
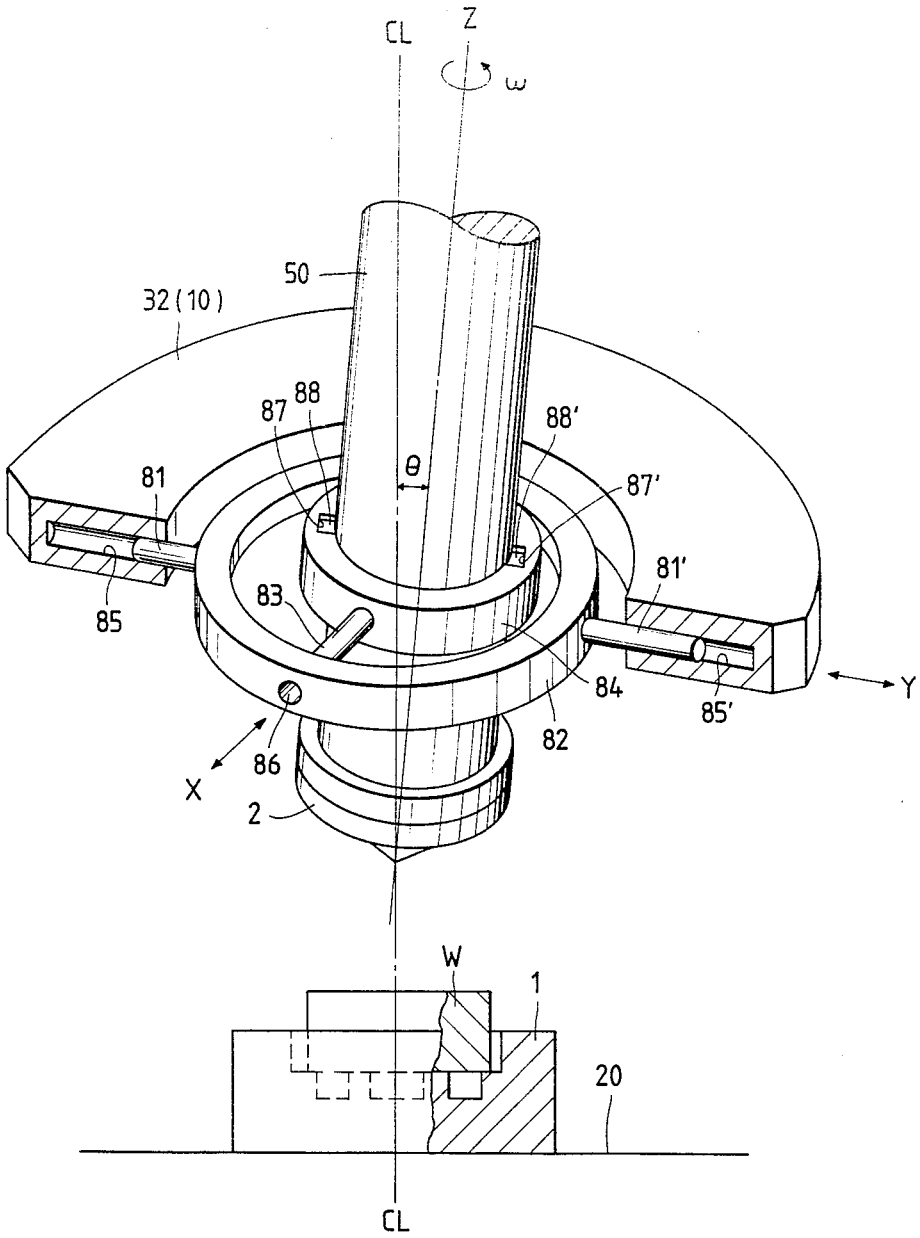
FIG. 6 is a perspective view showing a primary part of a molding die revolution preventing mechanism used in a swiveling type forging machine according to a third embodiment of this invention.

FIG. 6 is a perspective view schematically showing the molding die revolution preventing mechanism. A lower molding die 1 is fixed to a ram 20 and the workpiece W is mounted on the lower molding die 1. An upper molding die 2 is mounted on a molding die holder 50 extending obliquely and being swivelable relative to the machine center axis CL vertical to the lower molding die 1. The revolution of the holder is restricted by the molding die revolution preventing mechanism according to the invention.

In a stationary member 32 fixed to a body frame, two holes 85, 85' are formed and extend in a direction perpendicular to the machine center axis CL. Within an inner space defined by the stationary member 32, a first annular member 82 is provided. First shafts 81, 81' extend radially outwardly in diametrically opposite directions from the first annular member 82, and are inserted into the holes 85, 85', so that the first annular member 82 is supported by the stationary member 32. With this structure, the first annular member 82 is swingable about an axis of the first shaft 81 and is slidably movable in the axial direction (Y direction in FIG. 6) of the first shafts 81, 81' relative to the stationary member 32.

Two holes 86, 86' are formed in a direction substantially perpendicular to the first shaft 81 in the first annular member 82. These holes 86, 86' extend in a diametrically opposite direction of the first annular member 82. A second annular member 84 is disposed within a space defined by the first annular member 82, and second shaft 83, 83' extend radially outwardly from the second annular member 84 in diametrically opposite directions. The second shafts 83, 83' extend in a direction perpendicular to the first shafts 81, 81', and are inserted into the holes 86, 86', so that the second annular member 84 is supported by the first annular member 82. With this structure, the second annular member 84 is swingable about an axis of the second shafts 83, 83' and is slidably movable in the axial direction of the second shafts 83, 83'(X direction relative to the first annular member and the stationary member 32.

Two grooves 87, 87' are formed in the inner circumferential surface of the second annular member 84 and extend in axial direction thereof. The molding die holder 50 is inserted into the second annular member 84. A pair of pins are implanted in a peripheral wall of the molding die holder 50, and are engageable with the grooves 87, 87'. With the structure, the second annular member 84 and the molding die holder 50 are movable relative to each other in a direction of the slanted axis Z but are not movable relative to each other in the rotational direction $\omega$. The first and second annular members B2, 84, the first and second shafts 81,81', 83,83' serve as means for controlling a self-rotation of the die holder about its axis, i.e., serve as means for preventing the die holder from being rotated about its axis.

The operation will be explained. The second annular member 84 is movable within a horizontal surface (XY plane) because of the sliding movement in the axial direction (Y-direction) of the first shafts 81, 81' and the sliding movement in the axial direction (X-direction) of the second axial shafts 83, 83'. The second annular member 84 can also be swiveled or swung about any axis passing through the XY plane because of the swing motion of the first annular member 82 about the axis of the first shafts 81, 81' and the swing motion of the second annular member 84 about the axis of the second shafts 83, 83'. The movement in the axial direction (Z-direction) of the molding die holder 50 is not restricted by the second annular member 84 because of the sliding engagement of the pins 88, 88' relative to the grooves 87, 87'. Therefore, the molding die holder 50 may take many posture, and its revolution position about the axis (Z-axis) is only restricted by the engagement between the pins 88, 88' and the grooves 87, 87' and the member 32 integrally formed with the body frame 10.

Therefore, even if the molding die holder 50 is slanted in any way or swingingly or swivelingly moved, the revolution position of the molding die holder 50 is restricted by the stationary member 32 integrally formed in the stationary body frame 10 so that the revolution position is kept constant relative to the lower molding die 1. Accordingly, the revolution position between the upper molding die 2 and the lower molding die is not changed, to thereby perform the most abrupt slippage suitable for performing coining work or the like.

Figure 7:
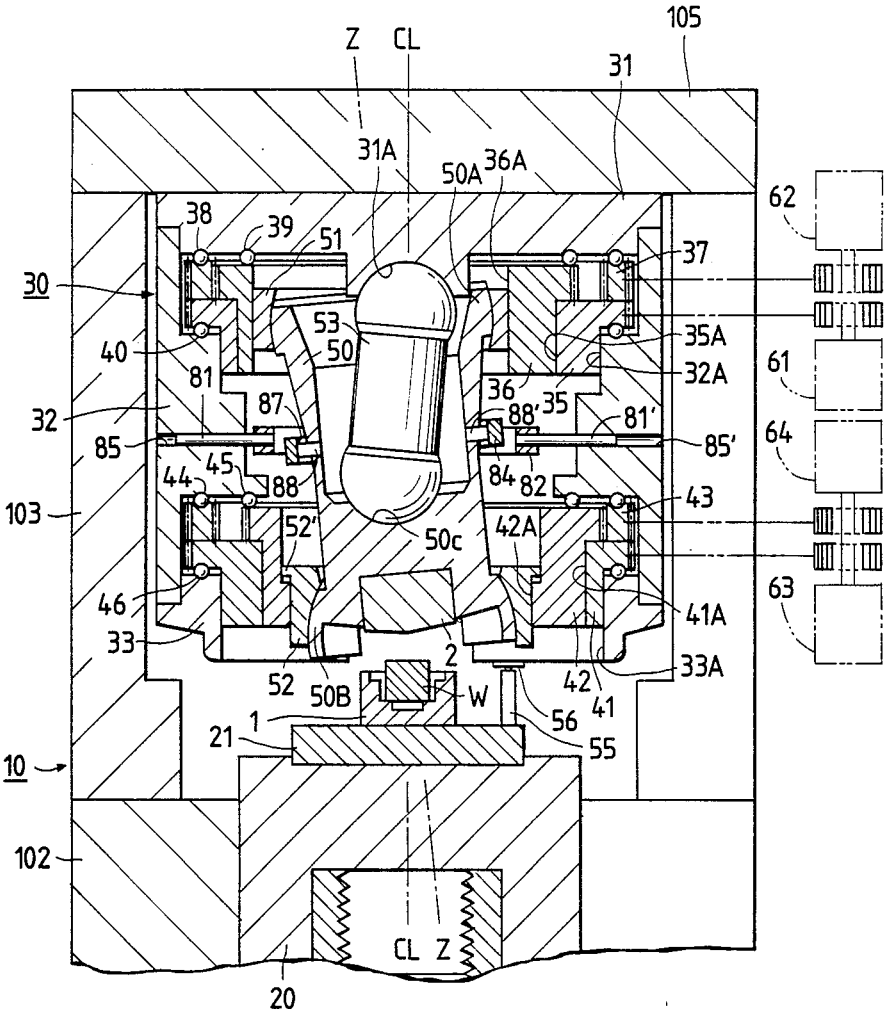
FIG. 7 is a cross-sectional view showing the swiveling type forging machine incorporating the molding die revolution preventing mechanism according to the third embodiment of this invention.

FIG. 7 is a cross-sectional view showing a mechanical structure of the rotary forging machine incorporating the molding die revolution preventing mechanism. A body frame 10 is integrally formed of a bed portion 102, a side plate portion 103 and a ceiling plate member 10. One side (right side in FIG. 7) is opened for providing a power transmission mechanism or for inspection. A ram 20 is slidably supported in the vertical direction to the bed portion 102 and is moved up and down by a drive means not shown.

The lower molding die 1 is fixed through the lower molding base 21 to the ram 20. A workpiece W is laid on the lower molding die 1. An upper molding die 2 is mounted on a die holder moving unit 30 fixed to a ceiling plate 105.

The die holder moving unit 30 will be explained. Three members such as a substantially disc-shaped upper lid 31, a substantially sleeve-shaped member 32 and a lower annular member 33 are combined integrally to form a hollow sleeve-shaped unit casing fixed to the ceiling plate 105 of the body frame 10. A spherical seat 31A is formed in a central portion of the upper lid 31, and the sleeve-shaped member 32 has an inner surface formed with a plurality of stepped portions.

An upper drive large gear 35 is rotatably inserted into an inner circumferential surface 32A of an upper portion of the sleeve member 32. The upper drive large gear 35 has an inner peripheral surface 35A eccentric relative to an outer peripheral surface thereof. An upper rotary gear 36 is rotatably inserted into the inner peripheral surface 35A. The upper rotary gear 36 has an eccentric inner peripheral surface 36A with the same eccentricity as that of the upper drive large gear 35. An annular upper drive small gear 37 having teeth on its outer and inner circumferential portions is rotatably provided on an upper surface of the upper drive large gear 35. The annular upper side drive small gear 37 is rotatable about an axis coaxial with a rotation axis of the upper drive large gear 35 and rotatable independent of the rotation of the large gear 35. Further, the inner teeth of the annular upper drive small gear 37 is meshedly engaged with a part of teeth of the upper rotary gear 36. The axial loads of the three gears 35, 36 and 37 are supported by three spherical connection chains 38, 39 and 40.

The three gears 35, 36 and 37 form a double eccentric mechanism. The eccentric position of the inner peripheral surface 36A of the upper rotary gear 36 relative to the center axis CL of the sleeve member 32 is determined by the rotational position of the upper drive large gear 35 and the upper drive small gear 37. The upper drive large gear 35 and the upper drive small gear 37 are driven by servo motors 61 and 62, respectively, and the rotational positions of these gears 35 and 37 are controlled.

The same is true with respect to another double eccentric mechanism provided at a lower portion of the sleeve member 32 which constitutes the unit casing. Namely, a lower drive large gear 41 is rotatably inserted into an inner circumferential surface 33A of the annular member 33 which also forms a part of the unit casing. A lower rotary gear 42 is rotatably inserted into an eccentric inner peripheral surface 41. The lower rotary gear 42 is meshedly engaged with inner teeth of a lower annular drive small gear 3. The three gears 41, 42 and 43 are supported by three spherical connection chains 44, 45 and 46. The lower rotary gear 41 and the lower annular drive small gear 43 are drivingly rotated by servo motors 63 and 64, respectively.

Upper and lower spherical bearings 51 and 52 for supporting the molding die holder 50 are inserted to be rotatable and slidable in the axial direction into the eccentric inner peripheral surfaces 36A and 42A of the upper rotary gear 36 and lower rotary gear 42. A flanged portion 52' is formed on the lower spherical bearing 52 for preventing the bearing from being released from the lower rotary gear 42.

A molding die holder 50 has a cup shape configuration provided with a bottomed sleeve shape. Spherical portions are formed in the vicinity of the upper and lower end portions of the holder 50 to constitute annular spherical portions 50A and 50B. The molding die holder 50 is rotatably supported at its upper and lower spherical portions 50A and 50B by upper and lower spherical bearings 51 and 52, respectively, to the double eccentric mechanisms. The upper molding die 2 is mounted on the outer side of the bottom portion of the molding die holder 50. Also, a spherical seat 50C is formed on the inner side of the bottom plate portion of the molding die holder 50. A press rod 53 is inserted between the spherical seat 50C of the molding die holder 50 and the spherical seat 31A of the upper lid 31. The press rod 53 has spherical end portions slidingly engageable with the spherical seats 31A and 50C. The press rod 53 is rotatingly movable in sliding contact with the spherical seats 31A and 50C. The press rod 53 and the molding die holder 50 form a toggle mechanism.

In order to detect the distance between the die holder moving unit 30 thus structured and a lower die base 21 provided on the ram 20, an eddy current sensor 55 is provided on the lower die base 21. A detection plate 56 through which the eddy current flows is mounted on the annular member 33. The drive motors 61, 62 and the gears 35, 36, 37 serve as means for circularly moving the one end of the die holder 50, and drive motors 63,64 and gears 41,42,43 serve as means for circularly moving the other end portion (lower end portion) of the die holder about the vertical axis CL.

The molding die revolution preventing mechanism best shown in FIG. 6 is engaged with an axially center portion of the molding die holder 50, and more specifically, as shown in FIG. 7 the mechanism is connected to the outer peripheral portion of the die holder 50 at a position generally axially 0 center portion thereof. Namely, the radial holes 85, 85' are formed in the sleeve member 32 (referred to as the "stationary member 32" in the description in conjunction with FIG. 6) fixed to the body frame 10. The first shafts 81, 81' are inserted into the holes 85, 85', so that the first annular member 82 is supported by the sleeve 32. The second annular member 84 is supported in the inner portion of the first annular member 82 by the second shafts 83, 83'(not shown in FIG. 7 but shown in FIG. 6). The pins 88, 88' formed implanted in the wall of the molding die holder 50 are assembled to be engaged with the grooves 87, 87' formed in the second annular member 84.

The operation of the mechanism will be explained. It is possible to change the eccentricity of the axial center position of the upper spherical bearing 51 relative to the center axis CL of the sleeve member 32 by changing the rotational position of the annular upper drive small gear 37 relative to the upper drive large gear 35. After the determination of the eccentricity in accordance with the rotation of the upper annular drive small gear 37, the upper annular spherical portion 50A of the molding die holder 50 is drivingly swiveled while keeping its determined eccentricity by rotating integrally the annular upper drive small gear 37 and the upper drive large gear 35. In the same manner, the lower double eccentric mechanism is operated.. The lower annular spherical portion 50B may be drivingly swiveled by the suitable determination of eccentricity of the spherical portion 50B of the molding die holder 50 relative to the center axis CL.

Accordingly, a press toggle motion may be imparted to the molding die holder 50. That is the die holder 50 is swiveled about the center axis CL with changing orientation and inclination angle. Further, the drive large gears 35, 41 are not rotated together with the drive small gears 37, 43 and the drive small gears 37, 43 are rotated relative to the rotation of the drive large gears 35, 41, whereby it is possible to perform the swing motion rather than the swivel motion to the molding die holder 50. At this time, the vertical motion of the molding die holder 50 is determined by the toggle mechanism including the press rod 53. By suitably controlling the eccentricity of the lower spherical bearing 52, it is possible to perform the toggle motion without any vertical motion, or to add a large vertical motion to the die holder 50.

At this time, even if the respective gears 35, 37, 41 and 43 for forming the double eccentric mechanisms are rotated in any fashion, the molding die holder 50 slidably supported by the upper and lower spherical bearings 51 and 52 are not revolved about its own axis irrespective of the movement of these gears. The revolution position of the molding die holder 50 is restricted or limited by the sleeve member 32 integrally formed with the body frame 10 because of the engagement of the holder 50 with the revolution preventing mechanism 81 to 88.

Accordingly, even if various motions such as a swing swivel motion is provided while changing the swiveling/swinging center point of the molding die holder 50, it is possible to keep the revolution position constant and to keep constant the rotational positional relation between the upper and lower molding dies 2 and 1.

In the third embodiment, since the revolution position of the molding die holder 50 is restricted by the simple two annular members 82 and 84, it is advantageous to control the revolution position of the molding die 2 irrespective of the swing/swiveling position of the molding die 2. For this reason, since the rotational positional relation between the confronted dies 1 and 2 is restricted, it is possible to perform the rotary forging operation with a mold pattern giving to the upper molding die 2.

According to the invention, since means for controlling or restricting the revolution position of the molding die holder is provided yet allowing swiveling motion of the die holder, the following advantages may be ensured.

In the swiveling type plastic working machine according to the first embodiment of this invention, it is possible to control the revolution position of the molding die holder by the numerical control unit as desired. For this reason, the slippage between the molding die and the workpiece may be eliminated, and, reversely, it is possible to perform the plastic working in order to obtain high surface smoothness on the workpiece, which is required in the spinning machining, by generating a large controlled slippage.

Further, in accordance with the concept of slippage applied to the swiveling plastic working machine of this invention, it is possible to completely eliminate the slippage between the molding die and the workpiece. For this reason, it is possible to depress the workpiece toward the lower molding die located below or on a side of the workpiece, to thereby perform an exact power transfer to the workpiece, to thus perform exact translation of a mold pattern provided on the molding die to the workpiece surface.

Furthermore, in the swiveling type plastic working machine according to the second embodiment of this invention, since the revolutional position of the molding die holder is restricted or controlled by the three annular members, it is possible to control the revolution position of the molding die independently of the swiveling position of the molding die with a simple structure. For this reason, it is possible to perform a rolling forging by the perfect rolling contact without any slippage between the molding die and the workpiece, to thereby enhance the working efficiency. Also, since the rotational positional relation between the confronted molding dies may be controlled, it is possible to perform the rolling forging with a pattern given to the molding die similar to the first embodiment.

Furthermore, in the swiveling type plastic working machine according to the third embodiment of this invention, it is possible to fix the revolution position at a constant position while allowing various swiveling or swinging motions of the molding die holder. For this reason, since the rotational positional relation between the confronted molding dies are restricted at a constant relation, it is possible to perform the rolling forging with a pattern given to the molding die that is swingingly or swivelingly moved with complicated motions accompanying displacement of the swiveling or swinging center.

Moreover, in the swiveling type plastic working machine according to the third embodiment of this invention, since the revolution position of the molding die holder is restricted by the two simple annular members, it is possible to restrict the revolution position of the molding die irrespective of the swinging or swiveling position of the molding die.

While the invention has been described with reference to specific embodiments thereof, it would be apparent to those skilled in the art that various changes and modifications can be made therein without departing from the spirit and scope of the invention.

What is claimed is:

1. In a swiveling type plastic working machine including a frame which provides a vertical axis, a first die, a die holder for mounting the first die, and a second die confronting the first die for mounting thereon a workpiece, the workpiece being depressed by co-operation of the first and second die, thereby applying a plastic working to the workpiece, the improvement comprising:

the die holder provided obliquely with respect to the vertical axis, the die holder having its slanted axis and having one end portion and another end portion to which the first die is fixed, the workpiece being positioned at a generally intersecting point between the vertical axis and the slanted axis;

means for circularly moving the one end of the die holder to provide a swiveling motion thereof about the vertical axis, said means comprising a first servo motor; and means for controlling a self-rotation of the die holder about its slanted axis during swiveling movement of the die holder, said means comprising a second servo motor for rotating the die holder about the slanted axis, and a numerical control means for controlling the first and second servo motors.

2. The improvement according to claim 1, wherein the numerical control means performs a synchronous control of the first and second servo motors, so that a swivel direction of the molding die holder about the vertical axis and a self-rotational direction thereof about the slanted axis are opposite to each other, and the following relationship is met:

$$\Delta\omega=(1/\cos\theta-1)\omega$$

where $\theta$ is the angle defined between the vertical axis and the slanted axis, $\omega$ is an angular velocity in the swivel direction and, $\Delta\omega$ is an angular velocity in the rotational direction about the slanted axis.

3. The improvement according to claim 2, wherein the vertical axis is a center axis of the frame.

4. In a swiveling type plastic working machine including a frame which provides a vertical axis, a first die, a die holder for mounting the first die, and a second die confronting the first die for mounting thereon a workpiece, the workpiece being depressed by co-operation of the first and second die, thereby applying a plastic working to the workpiece, the improvement comprising:

the die holder provided obliquely with respect to the vertical axis, the die holder having its slanted axis and having one end portion and another end portion to which the first die is fixed, the workpiece being positioned at a generally intersecting point between the vertical axis and the slanted axis;

means for circularly moving the one end of the die holder to provide a swiveling motion thereof about the vertical axis, said means comprising a first servo motor; and means for controlling a self-rotation of the die holder about its slanted axis during swiveling movement of the die holder, said means comprising:

a second servo motor;

a first annular member rotatably supported about the vertical axis by the frame, the first annular member being drivingly rotated by the second servo motor;

a first shaft extending in a direction substantially perpendicular to the vertical axis;

a second annular member positioned in the first annular member and supported to the first annular member by the first shaft, the second annular member being movable in an axial direction of the first shaft and swingable about an axis of the first shaft relative to the first annular member;

a second shaft extending substantially perpendicular to the first shaft;

a third annular member positioned in the second annular member and supported to the second annular member by the second shaft, the third annular member being movable in an axial direction of the second shaft and swingable about an axis of the second shaft relative to the second annular member, the third annular member being connected to the molding die holder, and the molding die holder being movable relative to the third annular member in an axial direction of the slanged axis but unmovable relative to each other in a rotational direction thereof; and a numerical control means for controlling rotations of said first and second servo motors, whereby a slippage between the first and second servo motors, whereby a slippage between the first die and the workpiece is controlled from a zero to a predetermined level during the working operation.

5. The improvement according to claim 4, wherein the first shaft is provided integrally to the second annular member, and is inserted into the first annular member, and wherein the second shaft is provided integrally with the third annular member and is inserted into the second annular member.

6. The improvement according to claim 5, wherein the numerical control means performs a synchronous control of the first and second servo motors, so that a swivel direction of the molding die holder about the vertical axis and a self-rotational direction thereof about the slanted axis are opposite to each other, and the following relationship is met:

$$\Delta\omega=(1/\cos\theta-1)\omega$$

where $\theta$ is the angle defined between the vertical axis and the slanted axis, $\omega$ is an angular velocity in the swivel direction and, $\Delta\omega$ is an angular velocity in the rotational direction about the slanted axis.

7. The improvement according to claim 4, wherein the vertical axis is a center axis of the frame.

8. In a swiveling type plastic working machine including a frame which provides a vertical axis, a first die, a die holder for mounting the first die, and a second die confronting the first die for mounting thereon a workpiece, the workpiece being depressed by co-operation of the first and second die, thereby applying a plastic working to the workpiece, the improvement comprising:

the die holder provided obliquely with respect to the vertical axis, the die holder having its slanted axis and having one end portion and another end portion to which the fist die is fixed, the workpiece being positioned at a generally intersecting point between the vertical axis and the slanted axis;

means for circularly moving the one end of the die holder to provide a swiveling motion thereof about the vertical axis; and means for controlling a self-rotation of the due holder about its slanted during swiveling movement of the die holder, said means comprising:

a first shaft extending in a direction perpendicular to the vertical axis;

a first annular member supported by the first shaft to the frame, the first annular member being movable in an axial direction of the first shaft and swingable about an axis of the first shaft relative to the frame;

a second shaft extending in a direction perpendicular to the first shaft;

a second annular member positioned in the first annular member and supported by the second shaft to the first annular member, the molding die holder being connected to the second annular member and being movable in an axial direction thereof relative tot he second annular member but unmovable in a rotational direction relative to the second annular member, whereby rotation of the die holder about its slanted axis is prevented during swiveling motion thereof.

9. The improvement according to claim 8, further comprising means for circularly moving the other end portion of the die holder about the vertical axis, and wherein the means for circularly moving the one end of the die holder comprises a first double eccentric mechanism rotatably supported by the frame, and a first drive motor coupled to the first double eccentric mechanism, in the means for circularly moving the other end portion of the die holder comprises a second double eccentric mechanism rotatably supported by the frame, and a second drive motor coupled to the second double eccentric mechanism.

10. The improvement according to claim 8, wherein the first shaft is provided integrally to the first annular member and inserted into the frame, and the second shaft is provided integrally to the second shaft and is inserted into the first annular member.

11. In a swiveling type plastic working machine for performing a plastic working to a workpiece by depressing against the workpiece a molding die mounted on a molding die holder while swiveling the molding die holder about a vertical axis, the molding die holder having a slanted axis intersecting with the vertical axis in the vicinity of a working portion, the plastic working machine comprising:

a frame;

a first servo motor for drivingly swiveling the molding die holder about the vertical axis;

a first annular member rotatably supported about the vertical axis by the frame;

a second servo motor for drivingly rotating the first annular member;

a first shaft extending in a direction substantially perpendicular to the vertical axis;

a second annular member positioned within the first annular member and supported by the first shaft to the first annular member, the second annular member being movable in an axial direction of the first shaft and swingable about an axis of the first shaft relative to the first annular member;

a second shaft extending in a direction substantially perpendicular to the first shaft;

a third annular member positioned within the second annular member and supported by the second shaft to the second annular member, the third annular member being movable in an axial direction of the second shaft and swingable about an axis of the second shaft relative to the second annular member;

connecting means for connecting the third annular member to the molding die holder, the connecting means permitting the molding die holder to be movable in an axial direction thereof relative to the third annular member but preventing the molding die holder from being rotated about its slanted axis relative to the third annular member; and a numerical control means for controlling rotations of the first and second servo motors, whereby a slippage between the molding die and the workpiece is controlled from a zero to a predetermined level during the working operation.

12. In a swiveling type plastic working machine for performing a plastic work to a workpiece by depressing against the workpiece a molding die mounted on a molding die holder while swiveling the molding die holder about a vertical axis, the molding die holder having a slanted axis intersecting with the vertical axis in the vicinity of a working portion, said plastic working machine comprising:

a first shaft extending in a direction perpendicular to the vertical axis;

a first'annular member supported by the first shaft to the frame, the first annular member being movable in an axial direction of the first shaft and swingable about an axis of the first shaft relative to the frame;

a second shaft extending in a direction perpendicular to the first shaft;

a second annular member positioned in the first annular member and supported by the second shaft to the first annular member; and means for connecting the molding die holder to the second annular member, the connecting means allowing the molding die holder to be movable in an axial direction thereof relative to the second annular member and preventing the molding die holder from being rotated relative to the second annular member, whereby rotation of the die holder about its slanted axis is prevented during swiveling motion thereof.

* * * * *